US006718810B1

(12) United States Patent
Räsänen

(10) Patent No.: US 6,718,810 B1
(45) Date of Patent: Apr. 13, 2004

(54) METHOD AND APPARATUS FOR BRINGING ELONGATED METALLIC SCRAP INTO A MORE COMPACT FORM

(75) Inventor: Pentti Räsänen, Savonlinna (FI)

(73) Assignee: Savonlinnan PR-Urakointi Oy, Savonlinna (FI)

( * ) Notice: Subject to any disclaimer, the term of this patent is extended or adjusted under 35 U.S.C. 154(b) by 0 days.

(21) Appl. No.: 09/959,629

(22) PCT Filed: Sep. 29, 2000

(86) PCT No.: PCT/FI00/00832

§ 371 (c)(1),
(2), (4) Date: Dec. 6, 2001

(87) PCT Pub. No.: WO01/23115

PCT Pub. Date: Apr. 5, 2001

(30) Foreign Application Priority Data

Sep. 30, 1999 (FI) ..... 992115

(51) Int. Cl.[7] ..... B65H 18/10

(52) U.S. Cl. ..... 72/148; 72/387; 242/532.5; 242/532.6

(58) Field of Search ..... 72/148, 387; 242/527, 242/532.6, 532.7, 532.5, 533, 587.2, 597.5; 83/155

(56) References Cited

U.S. PATENT DOCUMENTS

| | | | | | |
|---|---|---|---|---|---|
| 1,159,781 | A | * | 11/1915 | McCoy | 242/532.6 |
| 1,270,188 | A | * | 6/1918 | Mochon | 242/532.6 |
| 2,448,097 | A | | 8/1948 | Hawthorne | 242/81 |
| 3,690,583 | A | * | 9/1972 | Herman | 242/531 |
| 4,099,682 | A | * | 7/1978 | Benuska | 242/532.6 |
| 4,212,179 | A | * | 7/1980 | Juergens | 72/148 |
| 4,550,881 | A | | 11/1985 | Boardman | 242/56 R |
| 5,308,236 | A | * | 5/1994 | Wing-Fai | 262/532.6 |
| 5,421,535 | A | | 6/1995 | Hemmert et al. | 242/471 |
| 5,533,689 | A | * | 7/1996 | Chalfant | 242/532.5 |

FOREIGN PATENT DOCUMENTS

| | | |
|---|---|---|
| EP | 0011006 | 5/1980 |
| FR | 2 228 571 | 12/1974 |
| WO | WO 00/56495 | 9/2000 |

* cited by examiner

*Primary Examiner*—David Jones
(74) *Attorney, Agent, or Firm*—James C. Lydon

(57) ABSTRACT

The object of the invention is a method and an apparatus for bringing elongated metallic scrap into a more compact form by bending the metallic scrap to be brought into a shape requiring less space substantially around a bending member (6*a*, 6*b*) comprised by a forming member (3).

18 Claims, 1 Drawing Sheet

Figure 1:
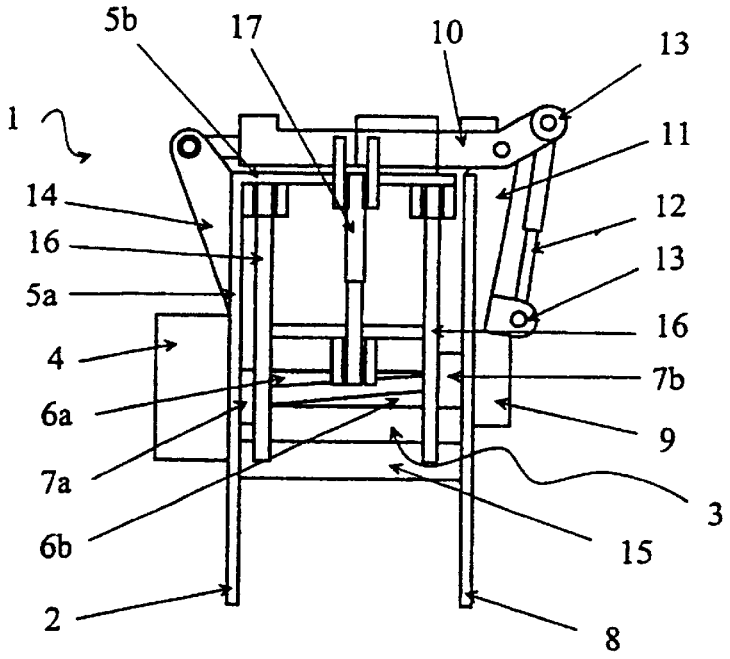

METHOD AND APPARATUS FOR BRINGING ELONGATED METALLIC SCRAP INTO A MORE COMPACT FORM

This application is a U.S. national stage of International Application PCT/FI00/00832, filed Sep. 29, 2000 and published on Apr. 5, 2001 in the English language, and which claims priority of Finnish application 19992115, filed Sep. 30, 1999.

The object of the invention is a method and apparatus according to the preambles of the independent claims presented below for bringing elongated metallic scrap into a more compact form.

The method and apparatus according to the invention for bringing elongated metallic scrap into a more compact form is particularly well applicable for collecting metal contained in demolition waste from demolition sites, and for bringing the metal into a form which occupies less space. In this context bringing metal in a more compact form means that the handling and transport of the metal is facilitated, for instance so that parts which are too long in the length direction of the transport vehicle are shaped so that the space they require is reduced and so that they will fit into the transport vehicle. Thus the transformation into a form requiring less space does not necessarily involve a reduction of the absolute i.e. actual total volume of the piece.

On demolition sites where structures typically made of different types of concrete, particularly armed concrete or the like are demolished, such as buildings and bridges, waste is created which in addition to other constituents contains metallic pieces, which are purely metallic or which in addition to the metal contain constituents which were attached to the metal, such as concrete remains. The produced metallic pieces can be collected and transported for instance to a metal smelting plant or a corresponding collection point in order to be reused. However, the metallic pieces produced on demolition sites are typically elongated, possible bent in many directions, and generally they require a large transportation space, so that their transport costs have become considerable and reduced the profitability of recycling metallic scrap.

Typically the above-described problem has been tried to remove by cutting the metal into shorter pieces and thus into a form requiring less transport space. The cutting has been typically made on a demolition site with the aid of metal cutters, welding blowpipes or correspondingly manually and centrally in one point, to which the pieces to be cut have been moved by cranes or the like, or the cutting has been made on the demolition site, at the metal pieces to be cut. The reduction of the transport space required by the metal pieces, made in the described fashion, is slow as the pieces are cut in small batches, mostly one by one. In addition the cutting of metal pieces is sometimes dangerous, because the metal pieces to be cut may be under tension, or during cutting they can otherwise cause danger situations to a person performing the cutting.

Another commonly known manner for bringing the metal contained in demolition waste from constructions into a transport form requiring little space is to move the demolition waste from the demolition site to a centralised point, where metallic scrap collected typically from several demolition sites is pressed into a pile, and from where the metal pressed into a compact form is transported to further processing.

The handling of the metal contained in demolition waste by a pressing apparatus is typically made by transporting a number of metal pieces into the pressing space, and the metal pieces are pressed by cylinders or corresponding other forming devices pushed by actuators, such as presses, into a metal body which is easier to handle and transport to further processing.

The biggest problem in the pressing of metallic scrap like that described above, has been the large space required by the pressing apparatus and the difficulty in moving it. Thus it has not been economically feasible to transport the pressing apparatus to demolition sites, but the waste has been transported to the pressing in a form requiring much space, causing unnecessary transport costs.

Thus, the object of the present invention is to provide an improved method and apparatus for bringing metallic scrap into a more compact form.

In this case the object is to provide such a method and apparatus for bringing metallic scrap into a more compact form, with the aid of which method and apparatus the metal originating at construction demolition sites can be mechanically transformed on the demolition site into a form requiring little transport space.

The object is particularly to provide a method and apparatus for bringing metallic scrap into a form requiring less space, advantageously by bending.

A particular object is to provide a method and apparatus for bringing metallic scrap into a form requiring less space, particularly by bending, which enables the metal to be bent rapidly, efficiently and safely.

A further object is to provide an apparatus for bringing metallic scrap into a form requiring less space, the apparatus bending at least one metallic waste piece into a substantially roll-like coil.

A further object is to provide an apparatus for bringing metallic scrap into a form requiring less space, which apparatus in connection with the bending removes structural parts attached to the metallic scrap, such as concrete blocks, bricks or the like.

In order to attain the above-mentioned objects the method and the apparatus according to the invention for bringing metallic scrap into a more compact form is characterised in what is presented in the characterising parts of the independent claims presented below.

In a method according to the invention elongated metallic scrap is typically brought into a more compact form with an apparatus which comprises a forming member and a driving device for operating the forming member, in which method the metallic scrap to be brought into a more compact form is bent substantially around a bending member, and the bending is made with at least two bending members located substantially adjacent to each other, of which bending members at least one is moved, the metallic scrap for bending being placed between the bending members. In this context metallic scrap means such metallic pieces, which are produced in demolishing different structures, such as buildings or bridges made for instance of concrete, such as armed concrete, or from other material, and which metallic pieces may comprise materials attached to the metal. Such metal pieces are for instance steel, prestressing steel and other reinforcement steel used when concrete is armed. Metallic scrap also means metal pieces of other kind which can be classified as metallic scrap according to their current use or operating characteristics. Such metallic pieces are for instance metal bands and bars used in binding packages and transport loads. Bending member means in this context a member which due to its construction and material is suitable to be used in metal bending. The bending member has such a form that the material to be bent can be bent around the member, for instance a shaft-like or a fork-like form. Bending metallic scrap around the bending member means in this context that after the bending the bending member is at least partly within the space formed by the bent metal body. Driving device means in this context a device, with the aid of which the bending member is moved. The driving device can be for instance an motor or a cylinder or some other actuator. The driving device can be located fixedly in connection with the bending member, or it can be connected to the bending member, for instance mechanically, hydraulically or pneumatically.

The metallic scrap to be bent can be placed, for instance with the aid of a member in the bending apparatus, or manually, or feeding with the aid of a separate machine. Moving the bending member means in this context that the bending member is brought in such a motion that the metal to be bent is bent around one or more bending members.

In an advantageous method according to the invention the bending members are moved by rotating a bending member, which is arranged to be moved, around a bending member, which is arranged to be stationary. In this case the metal to be bent is placed between the bending members and it will bend mainly around the stationary bending member.

In an advantageous method according to the invention the bending members are moved by rotating the bending members around the centre point left between two or more bending members, which are arranged to be movable. In this case the metal to be bent is located between the bending members and will bend around the bending members, which are located inside the motion path of the movable bending members. In this context the centre point left between the bending members refers to a point which is advantageously located in the space between adjacent bending members, into which space the metal intended for bending is placed.

An advantageous method according to the invention comprises at least the following steps:

- the bending apparatus is guided into the vicinity of the metallic scrap;
- some part of the metallic scrap is directed on a bending member with the aid of a member in the bending apparatus, advantageously in between the bending members;
- the bending member is moved, which results in that the metallic scrap is bent substantially around the bending member; and
- the metallic scrap bent around the bending member is removed from the bending apparatus.

In order to guide the bending apparatus, or in this case to move it, into the vicinity of the metallic scrap, the bending apparatus can be fastened for instance to an excavator or another movable construction machine which comprises the required members and devices for controlling and operating the bending apparatus. A member in the bending apparatus for guiding the metallic scrap onto a bending member refers in this context to all such members, as for instance bucket-like, shovel-like or scissors-like gripping apparatuses or other means, such as magnetic means, with the aid of which the metallic scrap to be bent can be gripped so that the metal body can be moved to the bending members. During the move the bending member can already be in the same position as during the actual bending, or the bending member can be moved for instance transversally in order to facilitate the guiding of the metal pieces to be bent. After bending the metallic scrap bent around a bending member can be removed from the bending apparatus, for instance by moving one or more bending members, so that a bending member within the bent metallic scrap is removed from within the metallic scrap. In this case the bent metallic scrap can be, for instance, dropped away from the bending apparatus by opening one or more of the walls of the bending apparatus, which walls keep the bent metallic scrap within the bending apparatus.

In an advantageous method according to the invention structural parts attached to the metallic scrap are removed from the metallic scrap during bending of the metallic scrap by guiding the metallic scrap to pass through a gap between a removing member and a bending member, the gap being substantially smaller than the above-mentioned structural parts to be removed. In this connection structural parts to be removed refer to bodies or accumulations of matter, which are attached to the metallic scrap to be bent, and which may originate for instance from the demolished structures or other demolition waste. The removing member used to remove the structural parts to be removed can be for instance a smooth, grooved or perforated plate-like piece, or a net-like, bar-like member or the like, which may be arranged to be movable so that the distance between the removing member and the bending member can be changed when bending metallic scrap of different thicknesses.

An apparatus for bringing metallic scrap into a more compact form comprises typically a frame, a forming apparatus connected to the frame, and a driving device for operating the forming apparatus. The forming apparatus comprises at least two bending members, which are arranged substantially next to each other, and between which bending members the metallic scrap to be bent can be placed in order to bend the metallic scrap around substantially at least one bending member. At least one of said bending members is arranged to be movable. In this context frame refers to the supporting structure of the apparatus to which the other parts of the apparatus can be fastened or connected. The supporting structure can comprise of one or more parts connected to each other in a fixed or removable manner. Regarding the other parts of the apparatus the support structure can be located within the other parts, outside them or both within and outside the other parts. The forming apparatus can be connected to the frame in a fixed or removable manner for instance by welds, by bolts, by screws, by rivets or in any corresponding fashion. In addition to the bending member incorporated in the forming apparatus, it can comprise needed means, such as bearings, and other means in order to facilitate the moving of the bending member and connecting it to the frame of the bending apparatus. Bending member refers in this context to a means which due to its construction and material is suitable to be used in metal bending. The bending member has such a form that the material to be bent can be bent around the member, for instance a shaft-like or a fork-like form. Bending of metallic scrap around the bending member refers in this context to the fact that after the bending the bending member is partly within the space formed by the metal body. The forming apparatus can also comprise a plurality of bending members which regarding each other are located so, that the metallic scrap to be bent can be bent with the bending apparatus according to the invention around one ore more bending members. The bending apparatus according to the invention can simultaneously bend one or more bodies of metallic scrap.

In an advantageous apparatus according to the invention the bending member, which is arranged to be movable, is arranged to be rotated around a bending member, which is arranged to be substantially stationary, in order to bend metallic scrap located between the movable and the stationary bending members. When metallic scrap is bent in such an apparatus the metallic scrap will be mainly wound around the stationary bending member. In an apparatus of this kind the stationary bending member acts as a bending surface, against which the metal being bent is bent with a bending member arranged to be movable.

In an advantageous apparatus according to the invention the bending members are arranged to rotate around the gap between the bending members in order to bend the metallic scrap located between them. In this connection the gap between the bending members refers to the region left between bending members which are positioned substantially in parallel, the bending point of the metallic scrap to be bent being located in this region.

The driving device in an advantageous apparatus according to the invention comprises a motor, advantageously a hydraulic motor. The driving device can be fastened in a fixed or removable manner either to the frame of the device or to the forming apparatus, or the driving device can be connected to the forming apparatus in some commonly known fashion in order to operate the forming apparatus. In this connection motor refers either to an electric motor, an internal combustion motor, a pneumatic or a hydraulic motor. In addition to a motor the driving device can comprise gears and other power transmission means required to operate the forming device.

In an advantageous apparatus according to the invention the bending member is arranged to be movable in order to remove metallic scrap bent around the bending member from the apparatus. In this context the mobility of a bending member for removing the bent metallic scrap refers to such arrangements which make it possible to move the bending member out of the space formed by the metallic scrap bent around the bending member. Such arrangements can comprise different cylinder or hinge solutions. A particularly advantageous apparatus according to the invention contains an actuator, advantageously a hydraulic cylinder, in order to move the bending member which is arranged to be movable.

An advantageous apparatus according to the invention has a means for guiding the metallic scrap onto a bending member, preferably between the bending members. Means in the apparatus for guiding the metallic scrap onto a bending member refers in this context to all such means, as for instance bucket-like, shovel-like or scissors-like gripping devices or other means, such as magnetic means, with the aid of which the metallic scrap to be bent can be gripped, so that the metal body can be moved on to the bending members.

An advantageous apparatus according to the invention has a removing member for removing structural parts attached to the metallic scrap, preferably so that the removing member is arranged to press the metallic scrap against a bending member. The removing member, used for removing the structural parts to be removed, can be for instance a smooth, grooved or perforated plate-like piece, or a net-like, bar-like member or the like, which may be arranged to be movable so that the distance between the removing member and the bending member can be changed when bending metallic scrap of different thicknesses.

The main advantage of the present invention is that with the method and apparatus according to the invention it is possible to bring metallic scrap rapidly, economically and safely into a form requiring less space for transport.

A further advantage of the invention is a reduced need for transport, as the metallic scrap can be transported directly from the demolition site for recycling.

In addition, an advantage of an embodiment of the invention is that during the bending of the metal, it will at the same time become detached from any matter parts, such as concrete blocks, which may have been attached to it.

Figure 2:
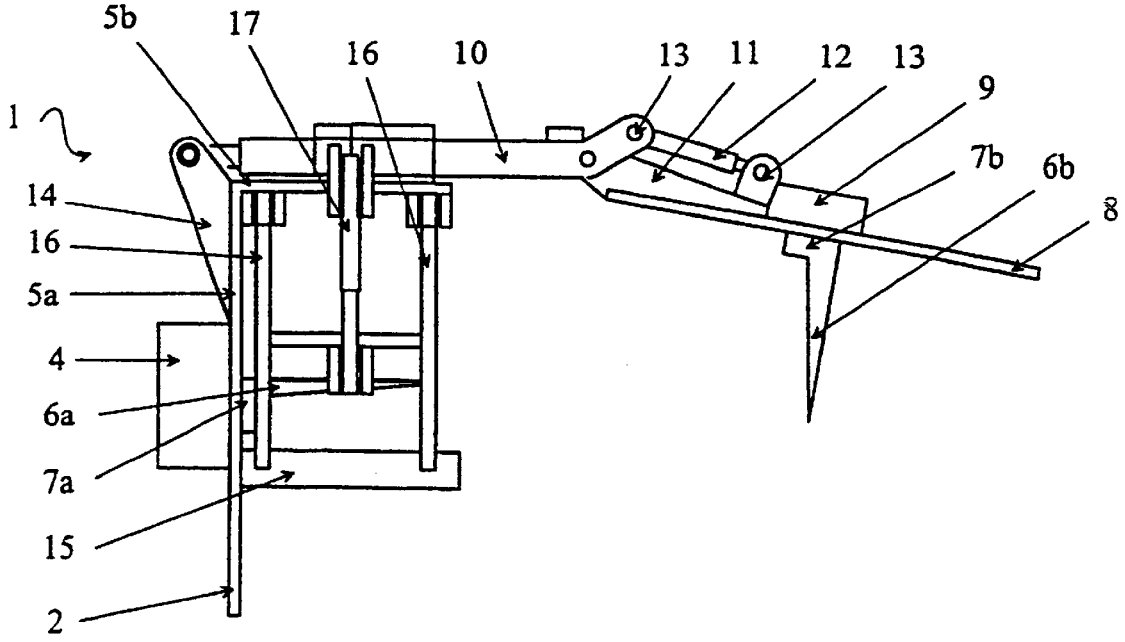

The invention is described below with reference to the enclosed drawing, in which FIG. 1 shows schematically and exemplary a vertical view of an apparatus according to the invention, and FIG. 2 shows schematically and exemplary a vertical view of an apparatus according to the invention as the second bending member is turned to one side.

FIGS. 1 and 2 show an apparatus 1 for bringing elongated metallic scrap into a more compact form. The apparatus 1 comprises a frame 2, a forming apparatus 3 fastened to the frame 2, and a driving device 4 for operating the forming apparatus 3. The frame 2 is assembled by welding the metallic frame components 5*a* and 5*b* into an L-shaped component. The forming apparatus 3 comprises two substantially conical bending members 6*a* and 6*b* placed substantially next to each other, the bending members having supporting parts 7*a* and 7*b* at their gripping heads. The bending members 6*a* and 6*b* can also have a straight form, a bent form, or they may comprise a number of members of equal or different forms attached to each other. The supporting parts 7*a* and 7*b* can have fittings for the point of the opposite bending members 6*a* and 6*b*, so that the point of the bending member 6*a* is partly inserted within the supporting part 7*b*, and correspondingly the point of the bending member 6*b* is partly inserted within the supporting part 7*a*. In this way it is possible to set both bending members 6*a* and 6*b* in motion with one driving device 4. The driving device 4 is fastened to the frame component 5*a* of the frame 2, so that it can be removed in order to facilitate any maintenance and service work. Advantageously the driving device comprises a motor, such as a hydraulic motor, and gears. The bending member 6*a* is connected to the driving device 4 through a fitting, such as a bore-like cutting in the frame component 5*a*. The bending member 6*b* is connected to a counterpart 8 with the aid of a bearing in the housing 9. The counterpart 8 is connected to the frame 2 with the aid of an opening cylinder 10 fastened to the frame component 5*b* and a swinging arm 11 pivoted on the opening cylinder 10 and a redirecting cylinder 12, so that the swinging arm 11 and the redirecting cylinder 12 are fastened to the counterpart 8. The redirecting cylinder 12 is pivoted on the opening cylinder 10 and the counterpart 8 through the cylinder bearers 13. The opening cylinder 10 is connected to the frame component 5*a* with the aid of a bearer component 14 which is fastened to the frame component 5*a*. A plate-like removing member 15 made of metal is connected to the frame component 5*b* through removing member arms 16 and a removing cylinder 17, which removing member arms 16 and the removing cylinder 17 are connected to the frame component 5*b* and to the removing member allowing a swinging motion. The apparatus 1 also has means for connecting the apparatus 1 to a device which can move the apparatus 1, for instance to an excavator, as well as connections for supplying the operating power to the driving device 4 and the cylinders 10, 12 and 17.

In the forming of demolition waste material, which is produced for instance on a demolition site and contains metallic scrap, into a more compact form in order to facilitate its removal, the apparatus 1 is guided close to the metal to be bent. The bending member 6*b* is guided farther away from the bending member 6*a* by swinging the counterpart 8 with the aid of the redirecting cylinder 12 and by pushing the counterpart 8 with the aid of the opening cylinder 10 away from the frame component 5*a*. The apparatus 1 is guided close to the metal for bending so that it almost touches it, and with the aid of the cylinders 10 and 12 the bending member 6*b* is guided next to the bending member 6*a,* and so that the point of the bending member 6*b* extends partly into the fitting in the supporting part 7*a* and so that the point of the bending member 6*a* correspondingly extends partly into the fitting in the supporting part 7*b,* in which case the metals to be bent are brought between the bending members 6*a* and 6*b.* With the aid of the operating power provided by the driving device 4 the rotation of the bending member 6*a* is initiated, in which case also the bending member 6*b* in connection with the supporting part 7*a* starts to rotate. The removing member 15 is placed close to the bending members 6*a* and 6*b* with the aid of the removing cylinder 17, in which case any extra material parts in the metal to be bent, such as concrete remains, will be loosened before they get between the bending members 6*a* and 6*b*. The rotation of the bending members is terminated when the metal to be bent has been bent around the bending members 6*a* and 6*b* by rotating the bending members 6*a* and 6*b*. The removing member 15 is moved farther away from the bending members 6*a* and 6*b*, and with the aid of the opening cylinder 10 the bending member 6*b* is moved farther away from the bending member 6*a,* and the bending member 6*b* is turned with the aid of the redirecting cylinder 12, in which case the bent metal left around the bending member 6*b* will be removed from the apparatus 1, and the bending of the next metallic scrap can be started. If the metal to be bent is such that it ten to straighten out after the bending, then the bent metal is tied up before the bent metal is removed from the apparatus 1.

The intention is not to restrict the invention to the embodiment presented above as an example, but instead the object is that it shall be interpreted widely within the scope defined in the claims presented below.

What is claimed is:

1. A method for bending elongated metallic scrap into a more compact form, comprising providing a bending machine which comprises a forming apparatus and a driving device for operating the forming apparatus, said forming apparatus comprising at least two separate bending members located substantially adjacent to each other during bending, wherein at least one bending member is movable and adapted to be guided to a second position that is substantially different from its position during bending of the metallic scrap to permit the removal of the bent metallic scrap, placing metallic scrap between the bending members, and bending said metallic scrap substantially around said forming apparatus so as to bring said metallic scrap into a more compact form.

2. The method of claim 1, wherein said at least one movable bending member is also rotated about at least one other of said bending members, which is arranged to be stationary.

3. The method of claim 1, wherein at least two of said bending members are movable, and rotate around a center point between said at least two bending members.

4. The method of claim 1, wherein the method comprises at least the following steps:

guiding said bending machine close to metallic scrap, placing at least part of said metallic scrap on at least one movable bending member, bending said metallic scrap substantially around said forming apparatus by moving said at least one movable bending member around at least one other bending member which is arranged to be stationary, and removing bent metallic scrap from the bending machine.

5. The method of claim 4, wherein said at least part of said metallic scrap is placed between said at least one movable bending member and said at least one other bending member.

6. The method of claim 1, further comprising removing structural parts attached to said metallic scrap by passing said metallic scrap through a gap between a removing member and at least one of said bending members.

7. A bending machine for bringing elongated metallic scrap into a more compact form, comprising a frame, a forming apparatus connected to the frame, and a driving device for operating the forming apparatus, wherein said forming apparatus comprises at least two separate bending members arranged substantially next to each other such that metallic scrap to be bent can be placed between said bending members, wherein at least one bending member is movable and adapted to be guided to a second position that is substantially different from its position during bending of the metallic scrap so as to permit removal of bent metallic scrap.

8. The bending machine of claim 7, wherein said movable bending member is arranged to be rotated around another of said bending members which is arranged to be substantially stationary, in order to bend metallic scrap located between the movable and the stationary bending members.

9. The bending machine of claim 7, wherein at least two bending members are movable, and rotate around a gap between them.

10. The bending machine of claim 7, wherein said driving device comprises a motor.

11. The bending machine of claim 10, wherein said motor is a hydraulic motor.

12. The bending machine of claim 7, further comprising an actuator adapted to move said movable bending member.

13. The bending machine of claim 12, wherein said actuator comprises a hydraulic cylinder.

14. The bending machine of claim 7, further comprising means for guiding metallic scrap onto a bending member.

15. The bending machine of claim 14, wherein said means for guiding the metallic scrap onto a bending member is adapted to guide the metallic scrap between the bending members.

16. The bending machine of claim 7, further comprising a removing member for removing structural parts attached to metallic scrap.

17. The bending machine of claim 16, wherein said removing member is adapted to press metallic scrap against one of said bending members.

18. The bending machine of claim 7, wherein said movable bending member is in a substantially different axis when said movable bending member is in said second position than when said movable bending member is in its position during said bending of said metallic scrap.

* * * * *